US006722167B1

(12) United States Patent
Hsu

(10) Patent No.: US 6,722,167 B1
(45) Date of Patent: Apr. 20, 2004

(54) CABINET LOCK

(76) Inventor: Long-Jung Hsu, 5th Fl., 117 Pao Chen, 15 Alley, Wu Pu Li, Hsin Pu Town, Hsinchu Hsien (TW)

( * ) Notice: Subject to any disclaimer, the term of this patent is extended or adjusted under 35 U.S.C. 154(b) by 0 days.

(21) Appl. No.: 10/445,887

(22) Filed: May 28, 2003

(51) Int. Cl.[7] ..... E05B 65/46

(52) U.S. Cl. ..... 70/78; 70/79; 70/85; 292/119; 292/129; 292/156; 292/157; 292/DIG. 18; 312/107.5; 312/218; 312/219

(58) Field of Search ..... 70/78–86; 109/47; 292/156–158, 116, 117, 119, 129, DIG. 18; 312/107.5, 216–219

(56) References Cited

U.S. PATENT DOCUMENTS

| | | | | | |
|---|---|---|---|---|---|
| 1,073,274 | A | * | 9/1913 | Millice | 312/218 |
| 1,193,955 | A | * | 8/1916 | Watson et al. | 312/217 |
| 1,353,453 | A | * | 9/1920 | Chipperfield | 312/218 |
| 1,370,089 | A | * | 3/1921 | Chipperfield | 312/218 |
| 2,091,382 | A | * | 8/1937 | Swimmer | 70/82 |
| 2,180,630 | A | * | 11/1939 | Hearn | 312/218 |
| 2,532,942 | A | * | 12/1950 | Reimer | 312/218 |
| 2,875,011 | A | * | 2/1959 | Higberg | 312/218 |
| 2,966,384 | A | * | 12/1960 | Bergman | 312/218 |
| 3,371,974 | A | * | 3/1968 | Vermeersch | 312/218 |
| 3,575,480 | A | * | 4/1971 | Peisker | 312/218 |
| 5,257,860 | A | * | 11/1993 | Slivon | 312/218 |
| 6,409,290 | B1 | * | 6/2002 | Lin | 312/219 |

FOREIGN PATENT DOCUMENTS

| | | | | |
|---|---|---|---|---|
| FR | 664063 | * | 8/1929 | 312/218 |
| FR | 708333 | * | 7/1931 | 312/218 |
| GB | 756583 | * | 9/1956 | 312/218 |
| GB | 967279 | * | 8/1964 | 312/218 |

* cited by examiner

*Primary Examiner*—Lloyd A. Gall
(74) *Attorney, Agent, or Firm*—Rosenberg, Klein & Lee

(57) ABSTRACT

A cabinet lock controlled by a press-button lock is disclosed to include an upright track affixed to the back side of the cabinet, a sliding locking bar vertically movably mounted in the upright track and adapted to hook the drawers in the cabinet, a linkage coupled between the top end of the upright track and the top end of the sliding locking bar and driven by the lock cylinder of the press-button lock through a push bar to move the sliding locking bar, and a spring member adapted to push the sliding locking bar upwards from the locking position to the unlocking position.

3 Claims, 8 Drawing Sheets

CABINET LOCK

BACKGROUND OF THE INVENTION

1. Field of the Invention

The present invention relates generally to locks and, more particularly, to a cabinet lock for use in a cabinet to lock drawers.

2. Description of the Related Art

FIGS. 1 and 2 show a cabinet lock according to the prior art. As illustrated, when the key 10 inserted into the lock body 11 and rotated, the lock cylinder 12 is driven to rotate a horizontal link 13, thereby causing the eccentric rear section 131 of the horizontal link 13 to lift/lower a vertical link 14. The vertical link 14 comprises a plurality of hooks 141 disposed at different elevations corresponding to the respective drawers 15. When the vertical link 14 lifted, the hooks 141 are respectively forced into engagement with the drawers 15, and therefore the drawers 15 are locked. On the contrary, when the vertical link 14 lowered, the hooks 141 are respectively disengaged from the drawers 15, and therefore the drawers 15 are unlocked. This design of cabinet lock is still not satisfactory in function. When locking or unlocking the drawers 15, the user must apply a strong rotary force to the key 10 to rotate the lock cylinder 12. Because the key 10 bears much torsional force, it tends to be deformed. If the drawers 15 are not respectively set into position when locking, the hooks 141 will not be forced into engagement with the drawers 15, and the lock cylinder 12 will receive an excessive resisting force, thereby causing damage to the cabinet lock. Further, if the key 10 is not turned to the locking or unlocking position accurately, an interference between the hooks 141 and the drawers 15 will occur when moving the drawers 15 in or out of the cabinet.

SUMMARY OF THE INVENTION

The present invention has been accomplished under the circumstances in view. It is the main object of the present invention to provide a cabinet lock, which is durable in use. It is another object of the present invention to provide a cabinet lock, which requires less effort to operate. To achieve these and other objects of the present invention, the cabinet lock comprises an upright track vertically mounted in the back side of the cabinet, the upright track comprising a plurality of sliding slots disposed at different elevations corresponding to the drawers of the cabinet, a top lug located on a top side thereof, and a bottom locating rod located on a bottom side thereof; a sliding locking bar vertically slidable mounted in the upright track, the sliding locking bar comprising a plurality of hooks respectively inserted through the sliding slots of the upright track and adapted to hook the drawers of the cabinet respectively, a top lug located on a top side thereof, and a bottom protruding rod downwardly extended from a bottom side thereof; a spring member coupled between the bottom locating rod of the upright track and the bottom protruding rod of the sliding locking bar and adapted to impart an upward pressure to the sliding locking bar; a push bar, the push bar having a front end and a rear end; a linkage coupling the rear end of the push bar to the top lug of the upright track and the top lug of the sliding locking bar; and a press-button lock, the press-button lock having a lock cylinder fastened to the front end of the push bar for enabling the sliding locking bar to be moved vertically in the upright track between a locking position and an unlocking position when the user operating the press-button lock.

DETAILED DESCRIPTION OF THE INVENTION

Figure 2:
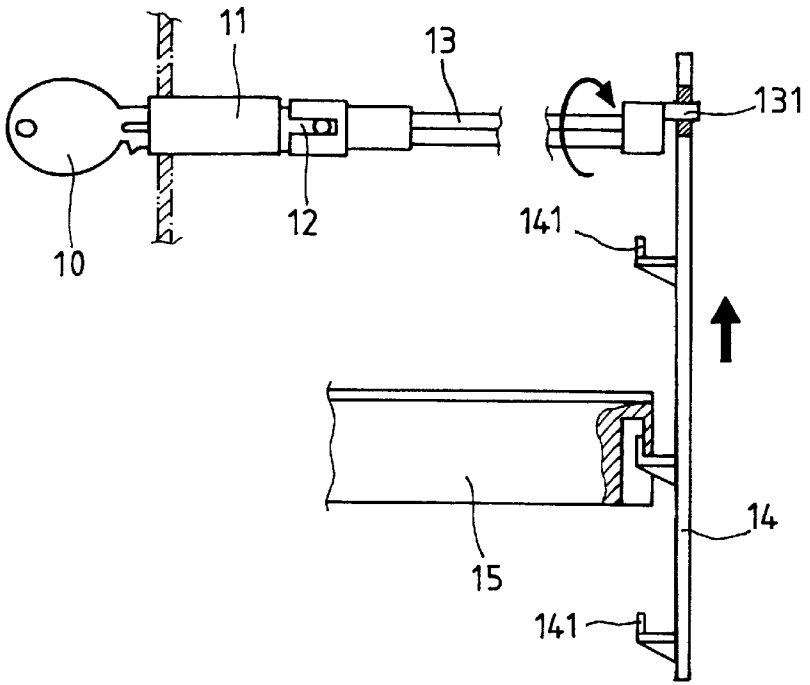
FIG.2 PRIOR ART
FIG. 2 is similar to FIG. I but showing the cabinet lock unlocked.
Figure 1:
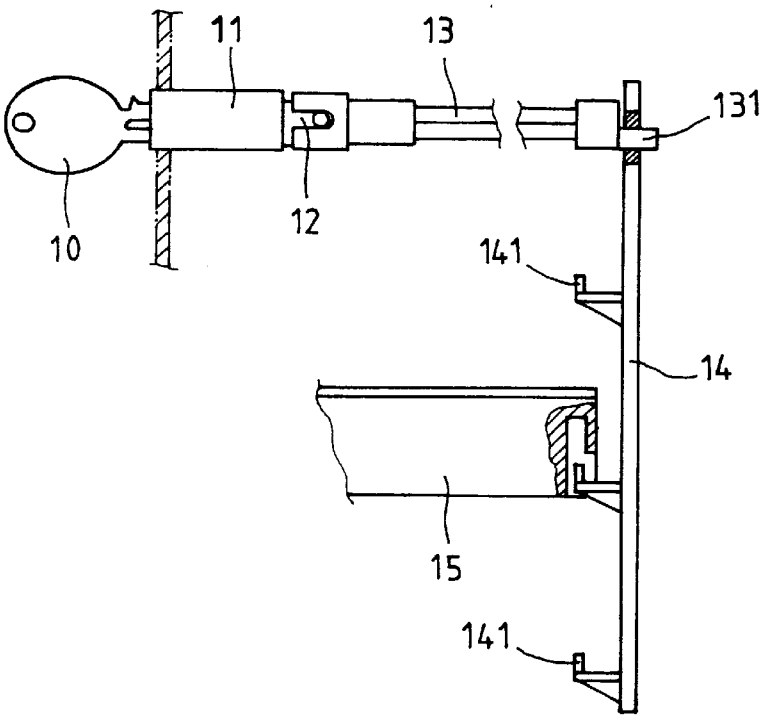
FIG.1 PRIOR ART
FIG. 1 is a schematic drawing showing a cabinet lock according to the prior art.
Figure 3:
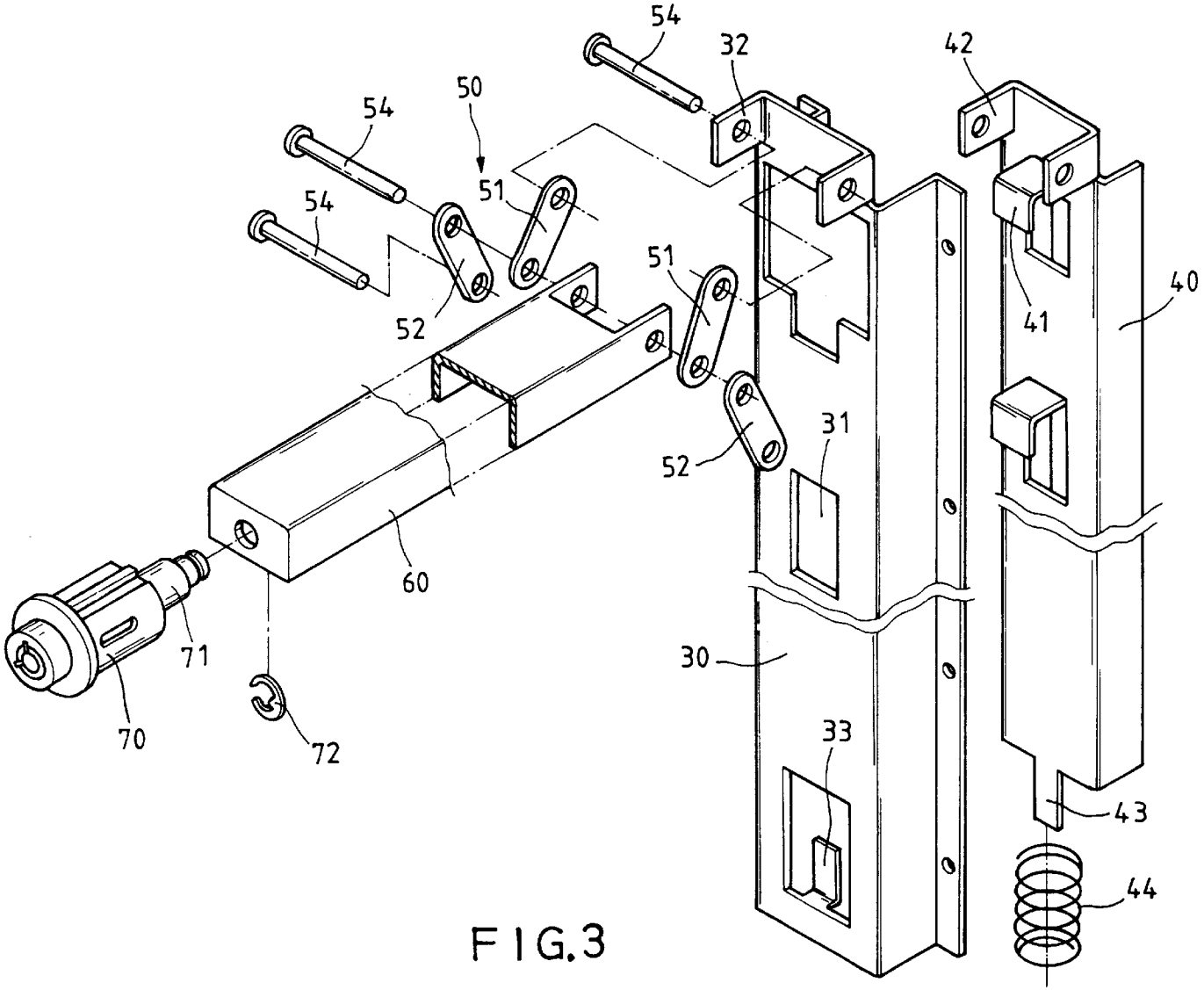
FIG. 3 is an exploded view of a cabinet lock according to the present invention.
Figure 4:
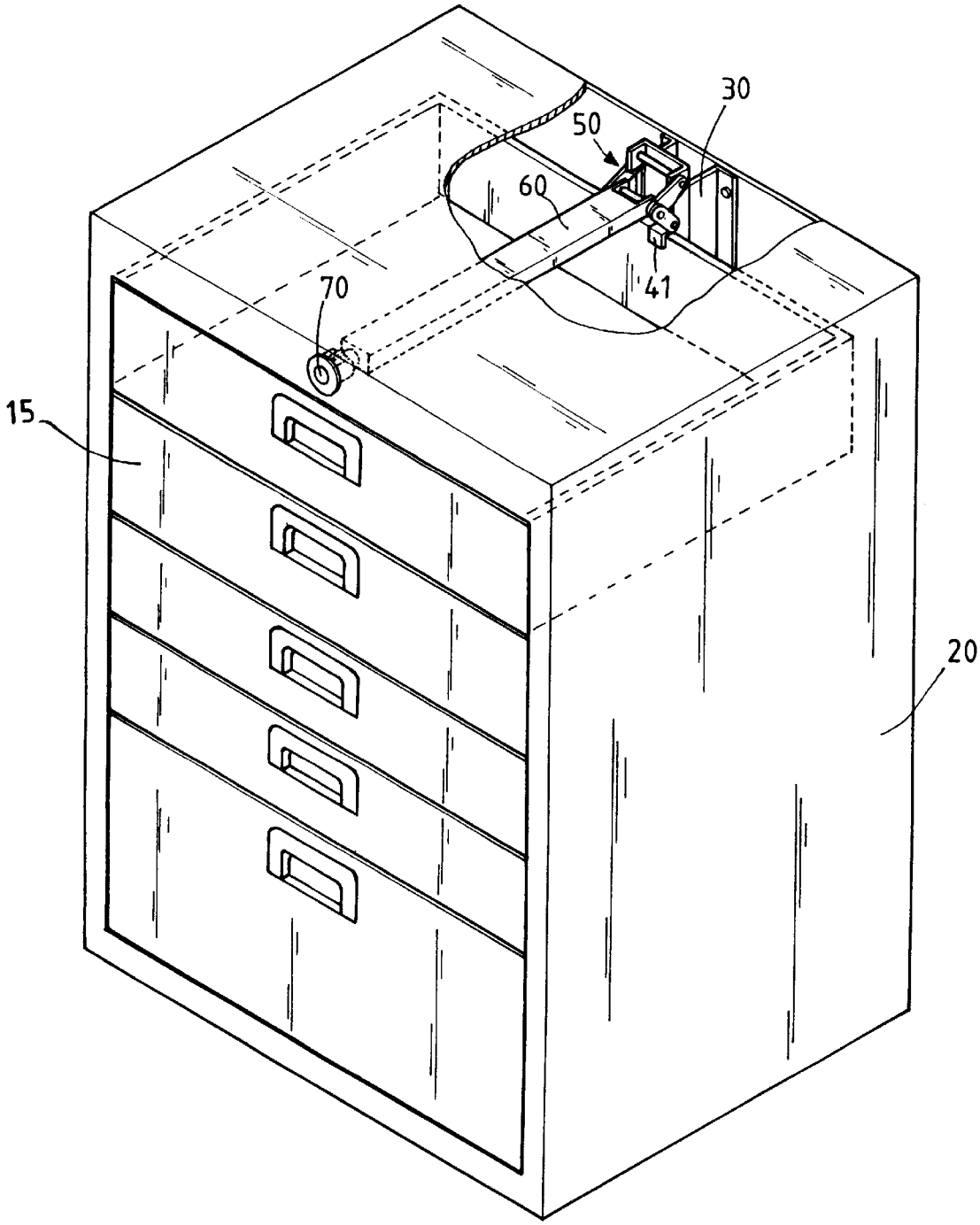
FIG. 4 is an applied view of the present invention, showing the cabinet lock installed in a cabinet according to the present invention.
Figure 5:
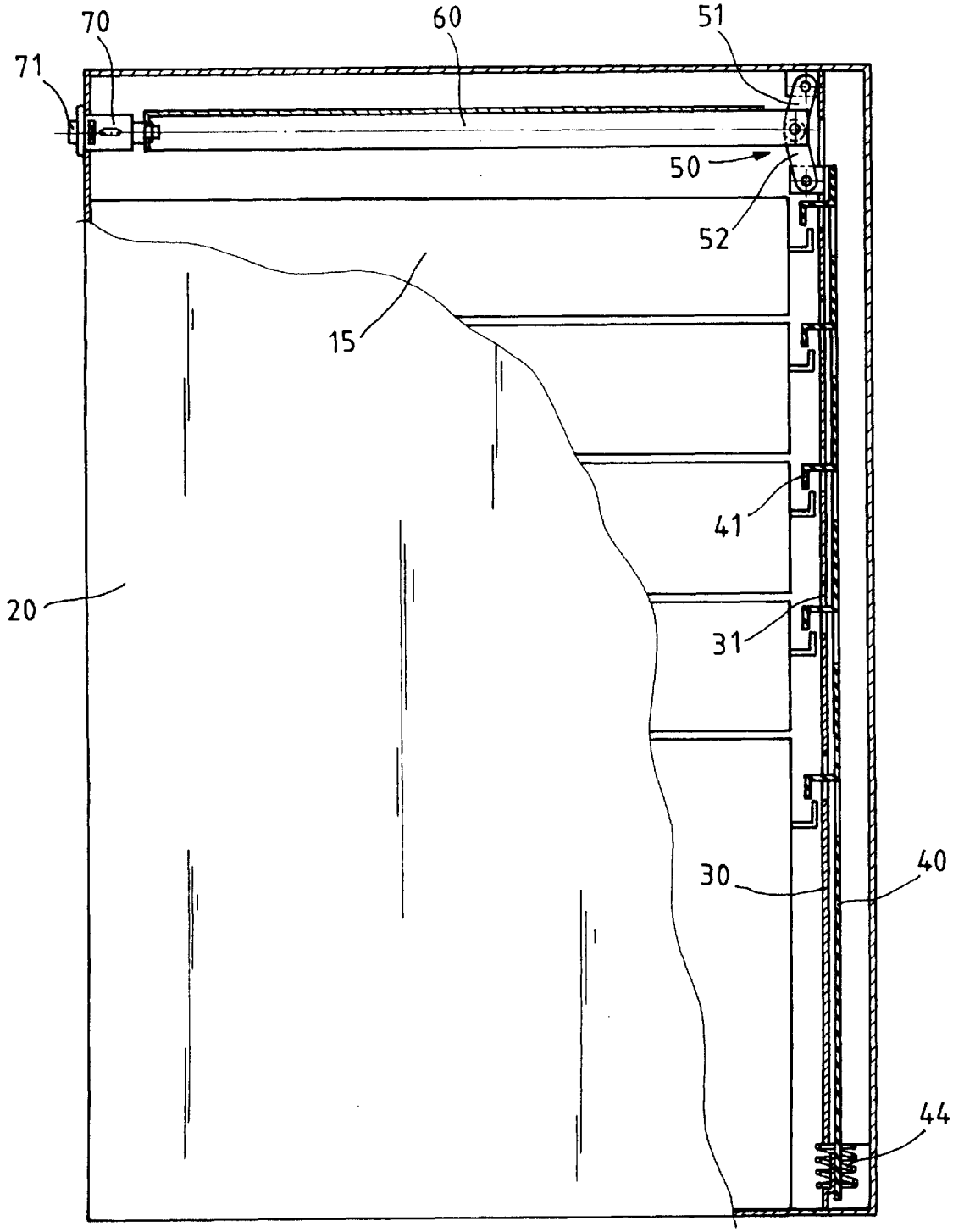
FIG. 5 is a sectional side view of FIG. 4.
Figure 6:
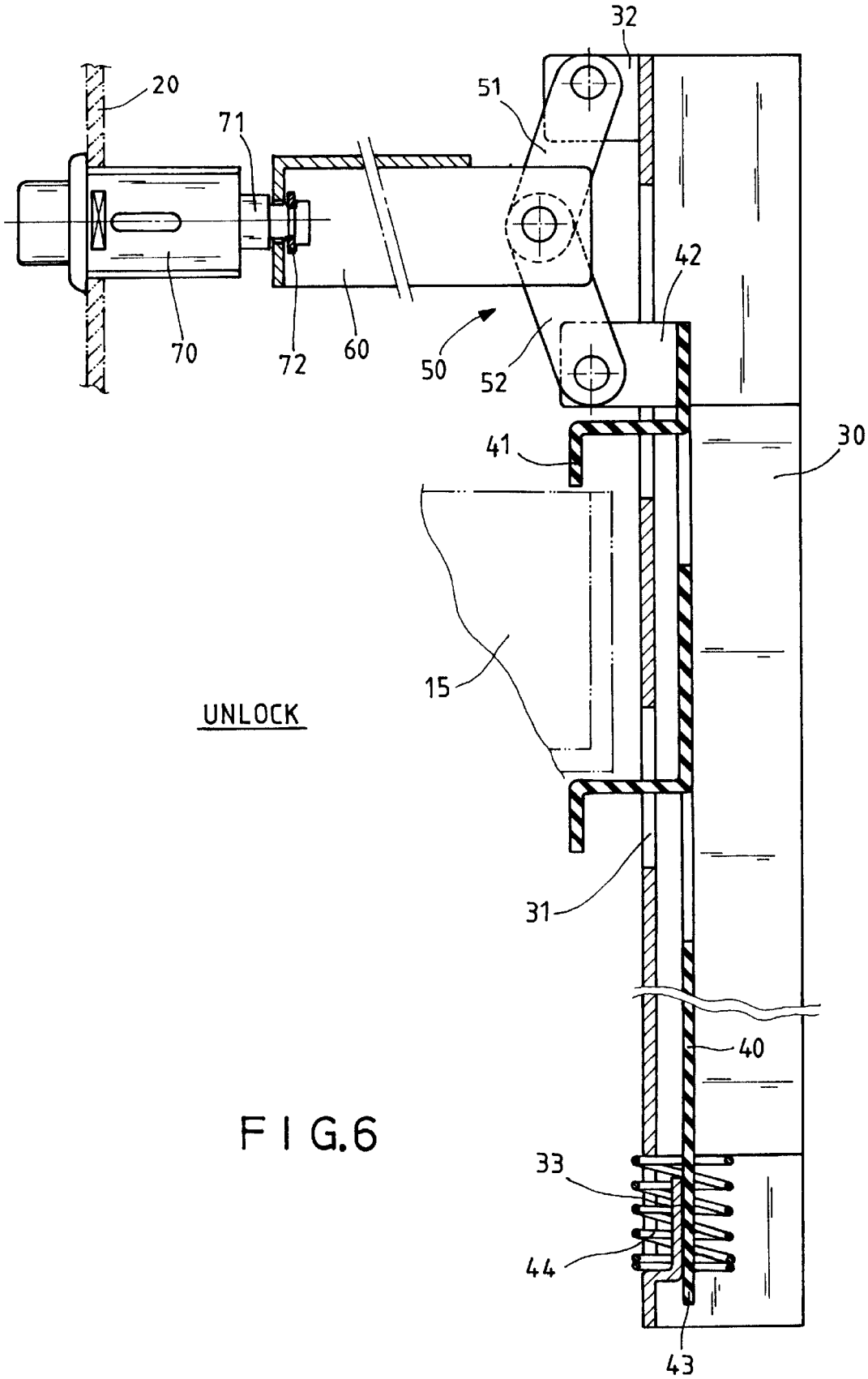
FIG. 6 is a schematic drawing showing the unlocking action of the cabinet lock according to the present invention.
Figure 7:
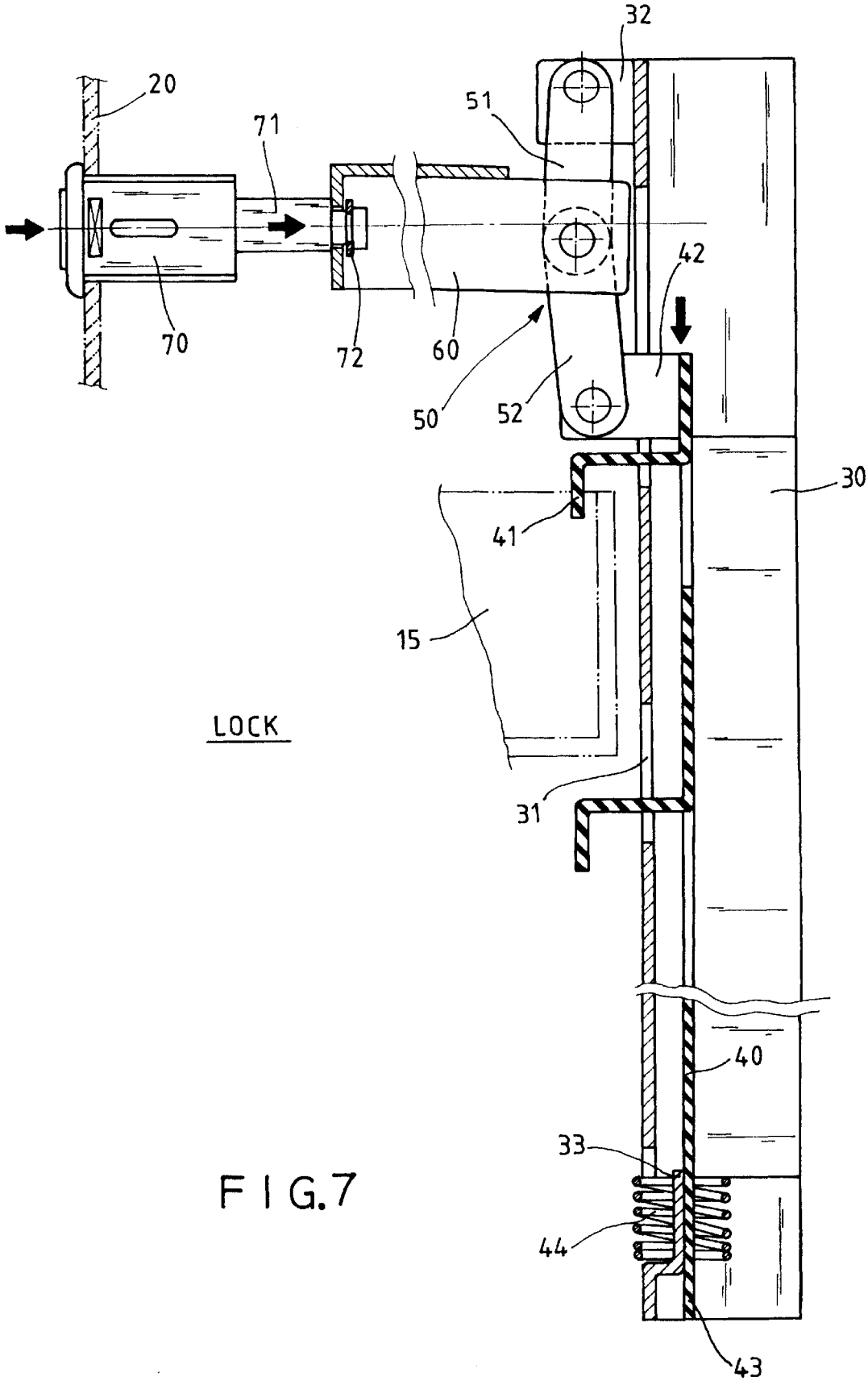
FIG. 7 is a schematic drawing showing the locking action of the cabinet lock according to the present invention.

Referring to FIGS. 3~7, a cabinet lock is installed in a cabinet 20 and adapted to lock the drawers 15 of the cabinet 20. The cabinet lock is comprised of an upright track 30, a sliding locking bar 40, a spring member 44, a linkage 50, a push bar 60, and a press-button lock 70.

The upright track 30 is vertically mounted in the back side of the cabinet 20, having a plurality of sliding slots 31 disposed at different elevations corresponding to the drawers 15, a top lug 32 located on the top side, and a bottom locating rod 33 located on the back side near the bottom side.

The sliding locking bar 40 is vertically slidable mounted in the back side of the upright track 30, comprising a plurality of hooks 41 respectively inserted through the sliding slots 31 of the upright track 30, a top lug 42 located on the top side, and a bottom protruding rod 43 downwardly extended from the bottom side.

The spring member 44 is coupled between the bottom locating rod 33 of the upright track 30 and the bottom protruding rod 43 of the sliding locking bar 40, and adapted to impart an upward pressure to the sliding locking bar 40.

The linkage 50 is comprised of a pair of first links 51 and a pair of second links 52. The first links 51 and the second links 52 each have a first end respectively pivoted to the top lugs 32 of the upright track 30 and the top lug 42 of the sliding locking bar 40 by respective pivots 54. The second ends of the first links 51 and the second ends of the second links 52 are pivotally connected to one end, namely, the rear end of the push bar 60 by a pivot 54.

The press-button lock 70 comprises a lock cylinder 71 fastened to the other end, namely, the front end of the push bar 60 by a C-shaped retainer 72. When pressed down the lock cylinder 71, the push bar 60 is forced to move the linkage 50, thereby causing the sliding locking bar 40 to be lowered, and therefore the hooks 41 are respectively hooked up with the drawers 15. At this time, the user can use the key to lock the press-button lock 70 in the locking position. When the press-button lock 70 unlocked, the user can press the lock cylinder 71 to release the sliding locking bar 40, enabling the spring member 44 to push the sliding locking bar 40 upwards, and the drawers 15 are disengaged from the hooks 41 of the sliding locking bar 40.

Figure 8:
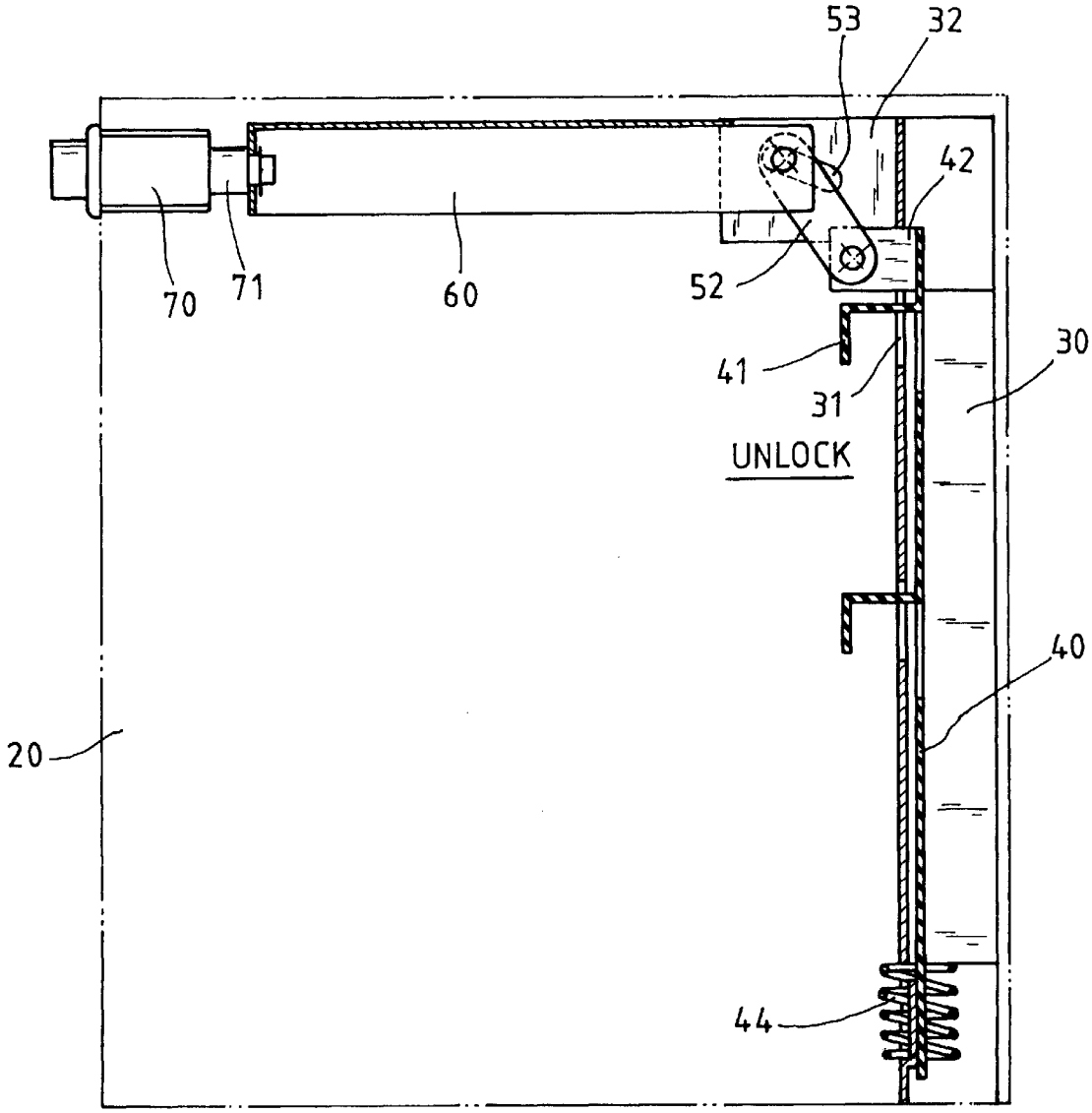
FIG. 8 is a schematic drawing showing the unlocking action of an alternate form of the cabinet lock according to the present invention.
Figure 9:
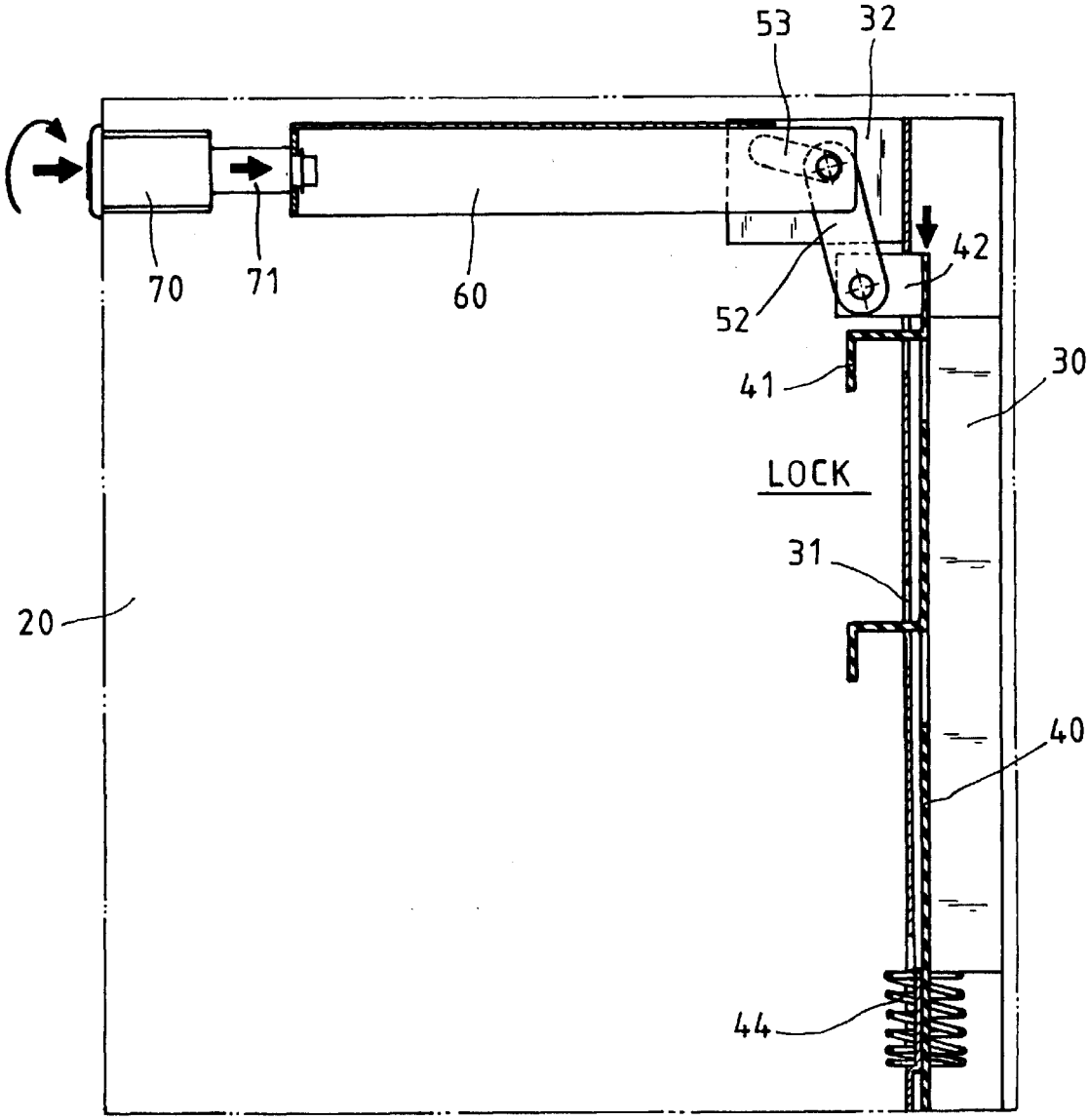
FIG. 9 is a schematic drawing showing the locking action of the alternate form of the cabinet lock according to the present invention.

FIGS. 8 and 9 show an alternate form of the linkage 50. According to this embodiment, the linkage 50 comprises only two links 52. The links 52 each have one end respectively pivoted to the top lug 42 of the sliding locking bar 40, and the other end pivoted with the rear end of the push bar 60 to a respective sliding slot 53 in the top lug 32 of the upright track 30 (i.e., the push bar 60 is pivoted with the links 52 to the top lug 32 of the upright track 30 by a slip joint).

A prototype of cabinet lock has been constructed within the features of FIGS. 3~9. The cabinet lock functions smoothly to provide all the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cabinet lock mounted in a cabinet and adapted to lock the drawers of the cabinet, comprising:

an upright track vertically mounted in the back side of the cabinet, said upright track comprising a plurality of sliding slots disposed at different elevations corresponding to the drawers of the cabinet, a top lug located on a top side thereof, and a bottom locating rod located on a bottom side thereof;

a sliding locking bar vertically slidable mounted in said upright track, said sliding locking bar comprising a plurality of hooks respectively inserted through the sliding slots of said upright track and adapted to hook the drawers of the cabinet respectively, a top lug located on a top side thereof, and a bottom protruding rod downwardly extended from a bottom side thereof, a spring member coupled between the bottom locating rod of said upright track and the bottom protruding rod of said sliding locking bar and adapted to impart an upward pressure to said sliding locking bar;

a push bar, said push bar having a front end and a rear end;

a linkage coupling the rear end of said push bar to the top lug of said upright track and the top lug of said sliding locking bar; and a press-button lock, said press button lock having a lock cylinder fastened to the front end of said push bar for enabling said sliding locking bar to be moved vertically in said upright track between a locking position and an unlocking position when the user operates said press-button lock.

2. The cabinet lock as claimed in claim 1, wherein said linkage comprises two first links, said first links each having a first end respectively pivoted to the top lug of said upright track and a second end respectively pivoted to the rear end of said push bar, and two second links, said second links each having a first end respectively pivoted to the top lug of said sliding locking bar and a second end respectively pivoted to the second ends of said first links and the rear end of said push bar.

3. The cabinet lock as claimed in claim 1, wherein said linkage comprises two links, each link having a first end respectively pivoted with the rear end of said push bar to the top lug of said upright track by a slip joint and a second end respectively pivoted to the top lug of said sliding locking bar.

* * * * *